United States Patent [19]

Shutoh

[11] 3,940,755

[45] Feb. 24, 1976

[54] PLASMA DISPLAY DRIVING APPARATUS

[75] Inventor: Masamichi Shutoh, Tokyo, Japan

[73] Assignee: Nippon Electric Co., Ltd., Tokyo, Japan

[22] Filed: Aug. 16, 1974

[21] Appl. No.: 498,134

[30] Foreign Application Priority Data

Aug. 22, 1973 Japan ..... 48-94171

[52] U.S. Cl. ..... 340/324 M; 315/169 TV

[51] Int. Cl.² ..... G08B 5/36

[58] Field of Search ..... 340/324 M, 173 PL; 315/169 R, 169 TV

[56] References Cited

UNITED STATES PATENTS

| | | | |
|---|---|---|---|
| 3,609,746 | 9/1971 | Trogdon | 340/324 M |
| 3,739,371 | 6/1973 | Hulyer | 340/173 PL |
| 3,803,449 | 4/1974 | Schmersal | 315/169 R |

*Primary Examiner*—David L. Trafton
*Attorney, Agent, or Firm*—John M. Calimafde

[57] ABSTRACT

Apparatus for driving a plasma discharge display employs a sustaining voltage pulse train source for quiescently energizing the display electrodes. To modify the display presentation, e.g., to initiate discharges at a new cell or terminate that previously obtaining, one of the sustaining voltage pulses is suppressed and an appropriate display changing signal introduced in its place.

Because the change signals are developed during the time interval otherwise allotted to a sustaining pulse, there is no requirement for an interval between sustaining pulses for display modifying signaling. Accordingly, the sustaining pulse rate can be rapid, resulting in a bright display with good operating margins.

1 Claim, 9 Drawing Figures

Figure 3:
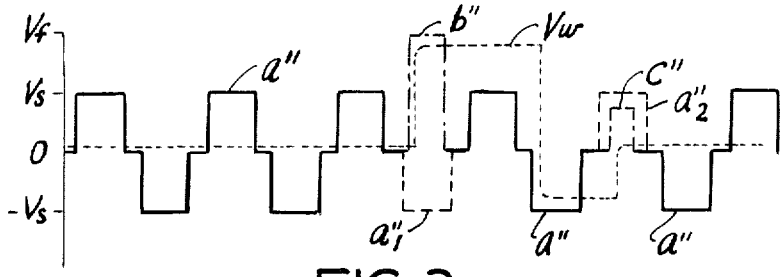

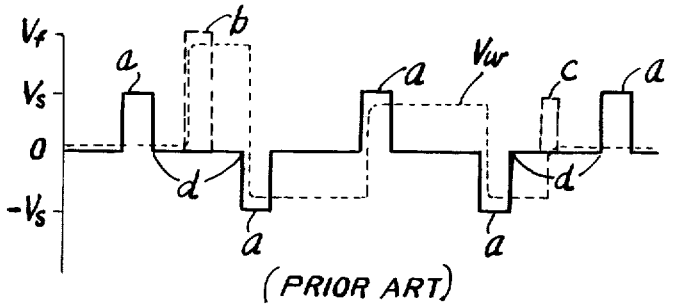
(PRIOR ART)
FIG. 1i
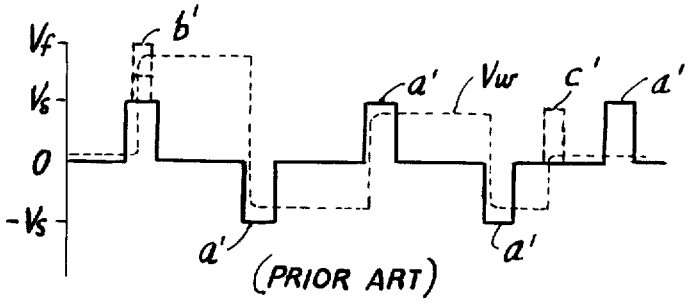
(PRIOR ART)
FIG. 1ii
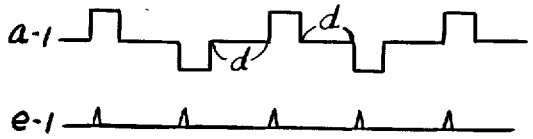
FIG. 2i
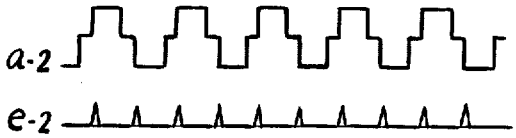
FIG. 2ii
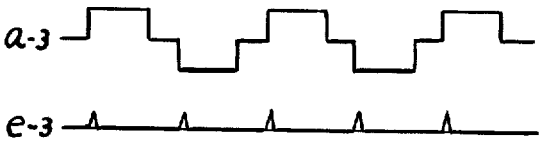
FIG. 2iii

PLASMA DISPLAY DRIVING APPARATUS

DISCLOSURE OF INVENTION

This invention relates to plasma display driving apparatus and, more particularly, to plasma display driving apparatus including a memory function.

In a basic driving method for a plasma display panel with memory, all electrode pairs are energized with an a.c. pulse voltage so that every discharge cell, i.e., every gas discharge space corresponding to the cross-points of a matrix (or all elements of another graphic display) at the intersecting electrodes is supplied with a discharge sustaining voltage lower than a discharge triggering voltage. If a display element is to be illuminated, a pair of electrodes are selected by applying a firing voltage pulse larger than the discharge triggering threshold across the discharge cell at the cross-point between the selected electrodes. Once the discharge has been initiated, the pulsating discharge is sustained by the wall charge deposited on the wall surfaces of the discharge cell and the discharge sustaining voltage. Each pictorial element can therefore be displayed as a luminous point.

When a discharging luminous picture element is to be extinguished, an erase voltage pulse of an appropriate amplitude is applied across the cell to be erased to reduce the wall charge formed on the wall surfaces of the cell to substantially zero.

The above-described plasma display system with the so-called memory attribute is believed to have favorable prospects for replacing CRT (Cathode Ray Tube) display systems, having as advantages the facts that the plasma display does not require a refresh memory, and that it can be digitally driven. Other advantages are that since the display member is transparent, it is possible to display an image projected by a slide projector or the like coincident with the displayed data; that the distortion of a displayed picture is small; and that the plasma display structure is relatively simple and characterized by a plane shape. For example, such a plasma display system forms a character display system or a graphic display system by the combination of a well-known character generator or a line segment generator so that it may be efficiently utilized for various display terminals in a data entry system, an information retrieval system, a CAI (Computer Assisted Instruction) system, or a pictorial response system.

Heretofore, in plasma display driving apparatus having the memory function based upon the above-described basic principles, driving methods as illustrated in FIGS. 1*i* and 1*ii* have been employed for developing the graphic presentation at the display panel. In FIGS. 1*i* and 1*ii* which show the voltage waveforms applied across a discharge cell in accordance with prior art driving techniques, the reference letters V*s* and V*f* represent the amplitude of the sustaining voltage and firing voltages, respectively.

In the method exemplified by the waveforms of FIG. 1*i*, a firing voltage pulse *b* or an erase voltage pulse *c* is generated adjacent in time to a sustaining voltage pulse *a*, that is, during an interval *d* when no sustaining voltage pulse is present. On the other hand, in the method illustrated in FIG. 1*ii*, a firing voltage pulse *b'* is supplied coincident with a positive sustaining voltage pulse *a'*.

In FIGS. 1*i* and 1*ii*, a waveform V*w* depicted by a dotted line shows the cell wall voltage. As shown in the respective drawings, a gas discharge is initiated by the application of the firing voltage pulses *b* and *b'*, respectively, hence creating wall voltage V*w* where none had previously obtained. Thereafter, due to the presence and effect of the wall voltage, the gas discharge can be sustained by the respective sustaining voltage pulses *a* and *a'*. As also shown in FIGS. 1*i* and 1*ii*, the erase pulses *c* and *c'* again reduce the wall voltage to zero, thereby terminating the gas discharge notwithstanding application of further sustaining pulses. The amplitude and duration (pulse-width) of the voltage pulses *c* and *c'* are chosen such that after the gas discharge caused by the generation of these pulses, the wall voltage may be reduced substantially to zero. The voltage pulses *c* and *c'* may illustratively have an amplitude smaller than the amplitude V*s* of the sustaining voltage pulses *a* and *a'*, and a pulse-width narrower than that of the pulses *a* and *a'*. The driving method of FIG. 1*i* is disclosed in FIG. 1 on page 105 of a paper entitled "INTERNATIONAL SYMPOSIUM: DIGEST OF TECHNICAL PAPERS", published by SID (Society for Information Display) in 1971 (Reference 1). The driving method of FIG. 1*ii* is disclosed in FIG. 5 on page 109 of Reference 1.

These prior-art driving methods are characterized by attendant disadvantages. Thus, the sustaining voltage pulses must maintain a sufficient interval as represented by the interval *d* to permit insertion of a firing voltage pulse *b* or an erase voltage pulse *c* or *c'* as shown in FIGS. 1*i* and *ii*. Further disadvantages for the prior-art methods of FIGS. 1*i* and *ii* will be described in more detail with reference to FIGS. 2*i*, 2*ii* and 2*iii*. In FIGS. 2*i*, *ii* and *iii*, symbols *a*-1, *a*-2 and *a*-3 represent waveforms of the sustaining voltage pulses, while symbols *e*-1, *e*-2 and *e*-3 represent the timing relationship of the discharge luminescence produced by the corresponding sustaining voltage pulses.

In the case of the prior-art method shown in FIG. 2*i* corresponding to FIGS. 1*i* and *ii*, the frequency of the sustaining voltage pulses cannot be raised to a value higher than a predetermined rate as above-discussed, and, accordingly, a display with high brightness cannot be obtained because of the limited number of discharges possible within a given period. Furthermore, since the interval *d* is needed, the width of the sustaining voltage pulse cannot be made larger than a predetermined value when the pulse frequency has a fixed upper bound. As a result, the display exhibits a relatively small operational margin.

Unless the period *d* is required, it is desired that the interval between the sustaining voltage pulses be made minimal to enhance the frequency of the sustaining voltage pulses, as shown in FIG. 2*ii*. A display with high brightness may thus be obtained or, even if the frequency of the sustaining voltage pulses is unchanged, the operating margin is increased by broadening the pulse-width as shown in FIG. 2*iii* so that stable driving operation may be obtained.

The method in which the firing voltage pulse is superimposed on the sustaining voltage pulse as shown in FIG. 1*ii* has the disadvantage that half-selected discharge cells are supplied with a voltage of ½ (V*f* + V*s*) that is higher by ½ V*s* than the half-selection voltage ½ V*f* in the case where the firing voltage pulse alone is applied. As a result, the driving procedure of FIG. 1*ii* increases the rick of erroneous firing.

It is therefore one object of the present invention to provide a plasma display driving apparatus which is free from the above-mentioned disadvantages inherent in the prior-art driving methods, and which is capable of performing stable driving operation and developing a display with high brightness.

The above and other objects of the present invention are realized in a specific, illustrative driving circuit of the present invention for a gas discharge display device having a pair of parallel spaced glass plates, each of the glass plates having an inside surface with a group of electrodes positioned in rows and with the electrodes on one glass plate being oriented at right angle relative to those on other glass plates. This permits a discharge at each cross-point between the electrodes by applying voltage therebetween, wherein the driving circuit comprises: circuitry for generating a reference sustaining signal pulse train characterized by a predetermined period; X-axis and Y-axis sustaining voltage driving circuitry responsive to the reference sustaining signal pulse trains for generating a sustaining voltage pulse train to be applied to the respective groups of the parallel electrodes; means for inhibiting the generation of selected pulses of a sustaining voltage pulse train; means for determing the timing for the suppression of sustaining pulses; circuitry for generating firing and erase timing pulses; X-axis and Y-axis firing-erase driving circuity for generating firing and erase voltage pulses, respectively; and circuitry for superimposing the firing and the erase voltage pulses on the sustaining voltage pulses in the X- and Y-axis directions, whereby a display with stability and high brightness is made possible by selectively providing a firing or an erase voltage pulse at an inhibited part of the sustaining voltage pulse train.

Figure 4:
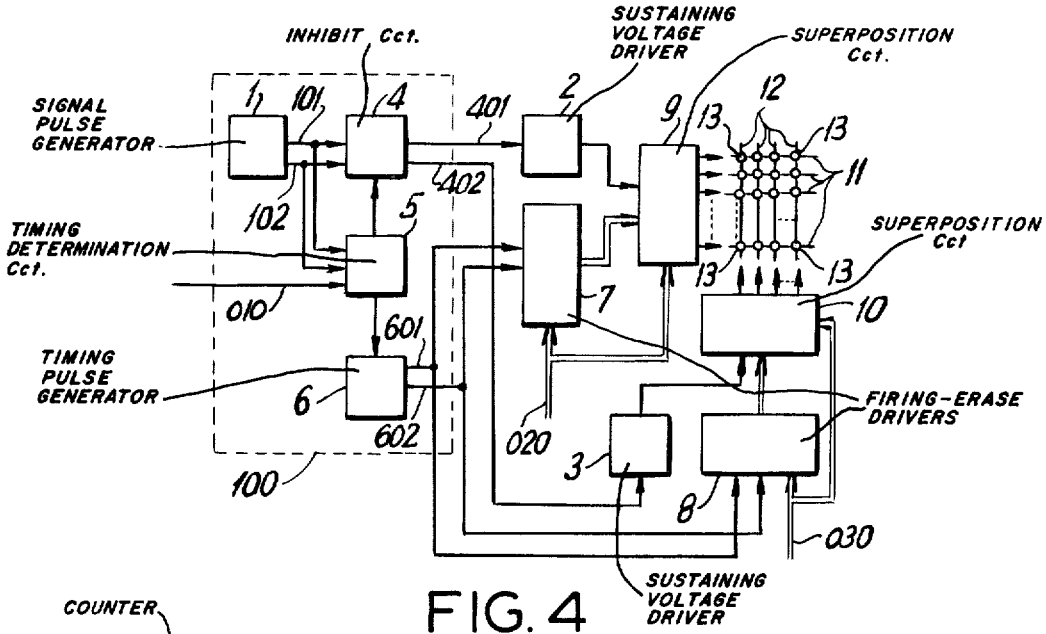
Figure 5:
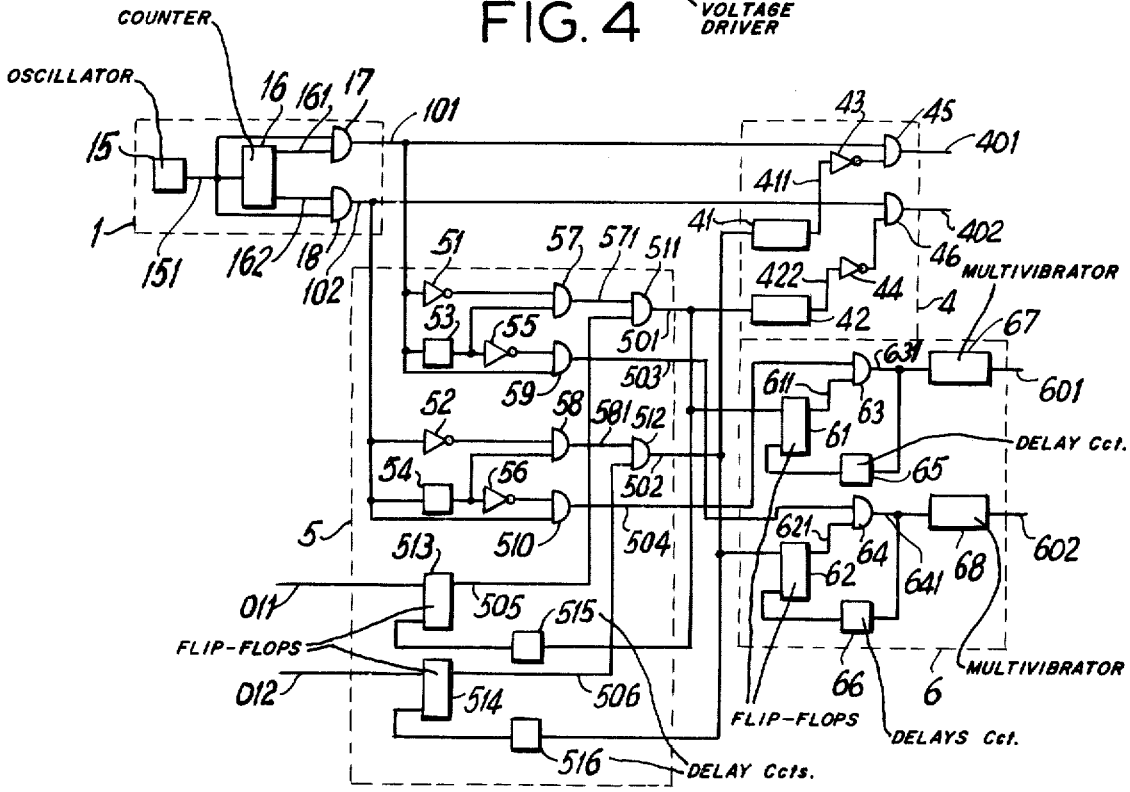
Figure 6:
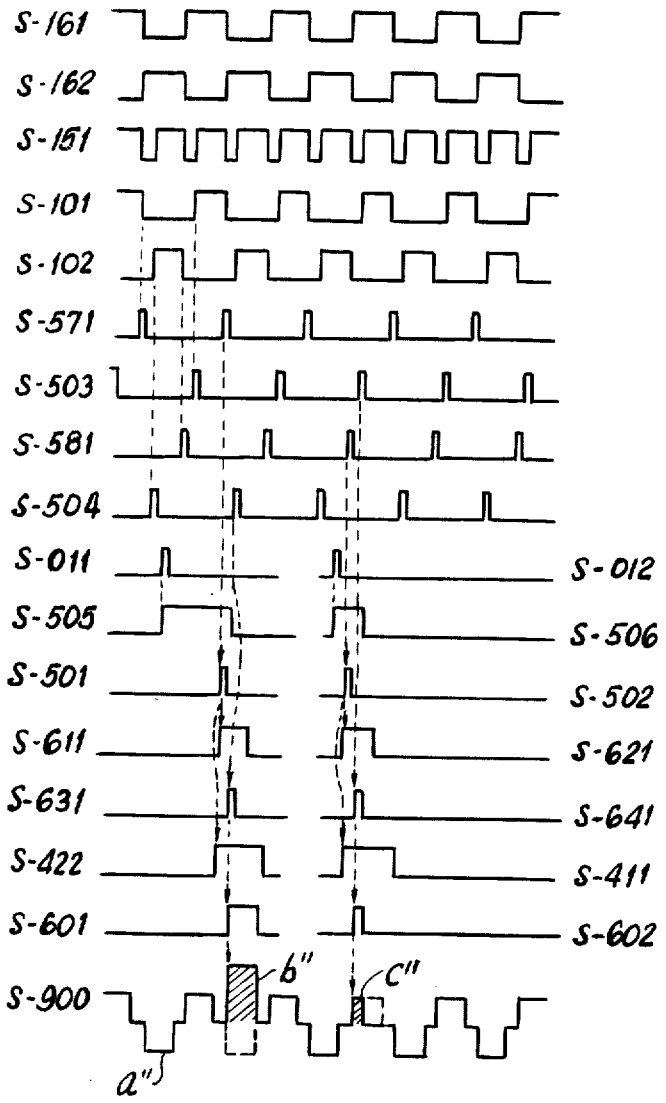

The features and advantages of the present invention will become more clear from the detailed description of a specific embodiment thereof presented herein below in conjunction with the accompanying drawings, in which:

FIGS. 1*i* and 1*ii* are timing diagrams of the driving waveforms characterizing two prior-art plasma display driving methods discussed above;

FIGS. 2*i* and 2*ii* and 2*iii* are diagrams for explaining the disadvantages of the prior-art driving methods;

FIG. 3 comprises a waveform for presenting operation of the present driving apparatus;

FIG. 4 is a block diagram of one specific embodiment of the present invention;

FIG. 5 comprises a diagram for showing in greater detail that part of the FIG. 4 apparatus encircled by a dash-line frame 100, constituents in FIGS. 4 and 5 being identified by the same reference numerals; and FIG. 6 illustrates the various signal waveforms characterizing principal elements of FIG. 5 (reference numerals with a prefix S given to each waveform being identical to the reference numerals of the signal lines of FIG. 5 on which the corresponding waveforms appear).

Turning now to FIG. 3, a pulse train $a''$ is continuously applied across all the discharge cells for providing the sustaining voltages. In a firing cycle of operation, a pulse $a_1''$ of the pulse train $a''$ is suppressed and a firing voltage pulse $b''$ is supplied during the $a_1''$ interval. Similarly, for an erase operation, a portion $a_2''$ of the pulse train $a''$ is similarly blocked and an erase voltage pulse $c''$ is supplied in place of the deleted pulse $a_2''$. When this method is employed, there is no necessity for providing an interval for inserting a firing or erase voltage pulse between sustaining voltage pulses. As a result, it becomes possible to obtain a display of high brightness by increasing the frequency of the sustaining voltage pulses, and also, to realize stable driving operation by using sustaining voltage pulses with a large pulse-width. In addition, since the firing pulses are isolated, the risk of erroneous operation in half-selected discharge cells as described above becomes very small.

It is noted that the waveform V*w* represented by a dotted line in FIG. 3 shows the variation of wall voltage generated by the firing voltage pulse $b''$, which terminates in response to the erase voltage pulse $c''$. A more detailed description of the variation of wall voltage is omitted herein since it has been briefly discussed in connection with FIGS. 1*i* and 1*ii*, and because it is well known per se and has no bearing on the subject matter of the present invention.

FIG. 4 shows a block diagram of one embodiment of the present invention, which includes a reference sustaining signal pulse generator 1 for continuously producing two reference sustaining signal pulse trains having a predetermined period. The signal pulse trains normally pass through inhibit circuitry 4 without interruption and are sent to sustaining voltage drivers 2 and 3 when a firing or erase operation is not being carried out. The drivers 2 and 3 generate sustaining voltage pulses in response to the reference sustaining signal pulse trains which are applied to X-axis electrodes 11 and Y-axis electrodes 12 through corresponding superposition (linear summing) circuits 9 and 10, respectively.

When a firing or an erase instruction signal is applied to a signal line 010, timing determining circuitry 5 determines the timing for inhibiting a part of the sustaining voltage pulse train e.g., the pulse $a_1''$ of FIG. 3, and the sustaining voltage pulse so identified is blocked by the inhibit circuitry 4.

A firing or an erase timing pulse is generated in a firing-erase timing pulse generator 6 coincident with suppression of the deleted sustaining pulse. Firing-erase drivers 7 and 8 generate firing or erase voltage pulses in response to a firing or an erase timing pulse which are supplied to the electrodes 11 and 12 through the summing, superposition circuits 9 and 10, respectively. A part of X-axis address designation signals on a signal line group 020 is fed to the firing-erase driver 7, and the remainder is sent to the circuit 9 so that only a particular electrode among the X-axis electrodes 11 is energized with the firing or the erase voltage pulse. In the same manner, in response to Y-axis address designation signals on a signal line group 030, only a particular electrode among the Y-axis electrodes 12 is energized with the firing or the erase voltage signal. Thus, each particular discharge cell 13 of the cell array can be selectively ignited or erased. After completion of a firing or erase operation, since the sustaining voltage pulses generated in response to the reference sustaining signal pulses are applied to every discharge cell 13, display information is preserved and sustained.

The circuit construction of the FIG. 4 drive arrangement is well-known except for the structure encircled by a dashed rectangle 100 in FIG. 4. For example, such circuitry is disclosed on pages 104–105 and pages 108–109 of Reference 1, the full disclosure of which is incorporated herein by reference. Accordingly, only the circuit construction of the block 100 will be described in greater detail hereinbelow with reference to FIG. 5, which shows detailed structure for the block 100, and FIG. 6 which shows signals waveforms characterizing operation of the FIG. 5 apparatus.

The reference sustaining signal pulse generator 1 is illustratively shown in FIG. 5 as formed by an oscillator 15, a binary counter 16 and AND-gates 17 and 18. Oscillation pulses from the oscillator 15 are shown at waveforms S-151 of FIG. 6, and have a frequency twice that of the reference sustaining signal pulse waveforms S-101 and S-102. The pulses are supplied to the counter 16. By taking logical products (coincidence logic) of the oscillation pulses and true and complementary outputs of the counter 16 as shown at waveforms S-161 and S-162, respectively, in the AND-gates 17 and 18, reference sustaining signal pulse trains such as shown at waveforms S-101 and S-102 are generated on signal lines 101 and 102. If it is assumed that the signal S-101 is used to produce the sustaining voltage pulses provided to the X-axis electrodes 11 of FIG. 4, the signal S-102 is used to generate the sustaining voltage pulses which drive the Y-axis electrodes 12 of FIG. 4.

The timing determination circuitry 5 for selectively blocking a part of the sustaining voltage pulses is illustratively formed of inverters 51, 52, 55 and 56, delay elements 53 and 54, AND-gates 57, 58, 59, 510, 511 and 512, flip-flops 513 and 514, and delay elements 515 and 516. The delay element 53, the inverters 51 and 55, and the AND-gates 57 and 59 produce timing pulses representing leading and trailing edges of the reference sustaining signal pulses S-101 appearing on the signal line 101. These circuit elements generate the leading edge pulses represented by waveform S-503 on a signal line 503 and the trailing edge pulses represented by waveform S-571 on a signal line 571. The delay element 54, the inverters 52 and 56, and the AND-gates 58 and 510 similarly produce, on a signal line 504, leading edge pulses S-504 of the reference sustaining signal pulses S-102 generated on the signal line 102, and generate on a signal line 581 trailing edge pulses S-581 of the pulses S-102.

The flip-flop 513 is set by a firing instruction signal S-011 on a signal line 011, and is reset by a pulse produced by slightly delaying an output pulse S-501 of the AND-gate 511 at the delay element 515. When the flip-flop 513 is in a set condition and its true output S-505 generated on a signal line 505 is "high", the AND-gate 511 is enabled and supplied to a signal line 501 the trailing edge pulses S-571 of the sustaining signal pulses S-101 appearing on the signal line 571.

The flip-flop 514 is set by an erase instruction signal S-012 impressed on a signal line 012, and is reset by a pulse produced by slightly delaying an output pulse S-502 of the AND-gate 512 via the delay element 516. When the flip-flop 514 is in a set condition and its true output S-506 on a signal line 506 is "high", the AND-gate 512 is enabled and generates on a signal line 502 the trailing edge pulses S-581 of the sustaining signal pulses S-102 appearing on the signal line 581.

The circuitry 4 for selectively inhibiting the sustaining voltage pulses supplied to the X- and Y-axis electrodes 11 and 12 of FIG. 4 may comprise monostable multivibrators (hereinafter abbreviated as MM) 41 and 42, inverters 43 and 44, and AND gates 45 and 46. The MM41 is triggered by the timing pulse S-502 produced on the signal line 502 and generates on a signal line 411 an inhibit signal S-411 having a pulse-width somewhat broader than that of the reference sustaining signal pulses S-101. The output of MM41 is supplied to the AND-gate 45 via the inverter 43 to block one pulse of the signal pulses S-101 appearing on the signal line 101. As a result, a sustaining signal pulse train having one inhibited pulse is produced on a signal line 401.

The MM42 is triggered by the timing pulse S-501 generated on the signal line 501 to generate an inhibit signal S-422 on a signal line 422 with a pulse-width also somewhat broader than that of the reference sustaining signal pulses S-102. The output of MM42 is applied to the AND-gate 46 via the inverter 44 to block one pulse of the signal pulses S-102, produced on the signal line 102. Accordingly, a sustaining signal pulse train with one inhibited pulse is produced on a signal line 402.

The firing-erase timing pulse generator 6 may comprise flip-flops 61 and 62, AND-gates 63 and 64, delay elements 65 and 66, and monostable multivibrators 67 and 68. The flip-flop 61 is set by the timing pulse S-501 appearing on the signal line 501, and is reset by a pulse produced by slightly delaying an output pulse S-631 of the AND-gate 63 with the delay element 65. The AND-gate 63 produces on a signal line 631 one of the leading edge pulses S-504 of the sustaining signal pulses S-102 appearing on the signal line 504 when the flip-flop 61 is in a set condition such that its true output S-611 produced on a signal line 611 is "high". This timing pulse S-631 appearing on the signal line 631 triggers the MM67 to impress a firing timing pulse S-601 on line 601 with an appropriate pulse-width.

The flip-flop 62 is set by each timing pulse S-502 generated on the signal line 502, and is reset by a pulse produced by a slightly delayed output pulse S-641 of the AND-gate 64 effected by the delay element 66. The AND-gate 64 generates on a signal line 641 one of the leading edge pulses S-503 derived from the sustaining signal pulses S-101 produced on the signal line 503, when the flip-flop 62 is set (its true output S-621 on signal line 621 is "high"). This pulse S-641 triggers the one shot circuit 68 to form an erase timing pulse S-602 with an appropriate pulse-width on the line 602.

When neither a firing nor erase command signal is applied, the reference sustaining signal pulses S-101 and S-102 generated by the generator 1 are continuously transmitted to signal lines 401 and 402, respectively.

To review the functioning above described, upon the application of the firing instruction signal S-011 to the signal line 011, a timing signal S-501 for inhibiting a sustaining voltage pulse is generated on the signal line 501, and the MM42 generates a signal with a pulse-width sufficient to completely block one pulse of the reference sustaining signal pulses — i.e., one pulse of the sustaining signal pulses S-102 is suppressed by the AND-gate 46. Simultaneously with the foregoing, the timing signal S-501 sets the flip-flop 61 so that one pulse of the leading edge pulses S-504 of the sustaining signal pulses S-102 is produced via the AND-gate 63 on the signal line 631. The multivibrator 67 generates the firing timing pulse S-601 on the signal line 601 during the period in which the sustaining signal pulse S-102 is blocked.

When an erase command signal S-012 is applied to the signal line 012, the timing signal S-502 for inhibiting a sustaining voltage pulse is generated on the signal line 502, and the MM41 generates a signal of sufficient pulse-width to block one pulse of the reference sustaining signal pulses. As a result, one pulse of the sustaining signal pulse train S-101 is inhibited by the AND-gate 45. At the same time, the timing signal S-502 sets the flip-flop 62 so that one of the leading edge pulses S-503 of the sustaining signal pulses S-101 is coupled via the AND-gate 64 to the signal line 641, and thereby to the MM68 which generates an erase timing pulse S-602 on the signal line 602 during the period in which a sustaining signal pulse S-101 is suppressed.

By reason of the structure and functioning abovediscussed, signal waveform S-900 as illustrated in FIG. 6 is developed as the driving voltage waveform applied to a discharge cell. This waveform S-900 includes sustaining voltage pulses $a''$; a firing voltage pulse $b''$; and an erase voltage pulse $c''$.

It is noted at this point in accordance with one aspect of the present invention, that a control pulse for driving a plasma display panel is inserted in the time period in which a sustaining voltage pulse is inhibited. Also, the driving waveform of FIG. 3 merely illustrates one illustrative example within the scope of the present invention and various modifications and adaptations thereto may be made. For instance, the timing relationship of the application of the firing voltage pulse and the erase voltage pulse could be reversed opposite to that shown in FIG. 3 so that the firing voltage pulse $b''$ is applied while the sustaining voltage pulse $a_2''$ is inhibited. Also, a voltage pulse with an opposite polarity to that of the pulse $c''$ may be applied while the sustaining voltage pulse $a_1''$ is inhibited for serving as the erase signal. The firing voltage pulse $b''$ as well as the erase voltage pulse $c''$ can be supplied at the timing of a sustaining voltage pulse $a_2''$ or $a_1''$. Further, the circuit construction shown in FIGS. 4 and 5 is merely one practical form of the present invention.

In the embodiment of the present invention explained with reference to FIGS. 4 to 6, only one firing operation or one erasing operation was performed. As a practical matter, however, a plurality of the firing or erasing operations must typically be carried out in order to continuously fire or erase a plurality of the discharge cells. With the present invention, since a part of the sustaining voltage pulse train is inhibited due to firing or erasing operations, it is necessary to consider the brightness change in the discharge cells forming the pictorial elements of the displayed image previously fired if firing or erasing operations are successively performed. In order to avoid a condition in which the sustaining voltage pulse train is continuously inhibited during sequential firing or erasing operations, consecutive firing or erasing instruction signals must be generated on the signal lines 011 or 012 only for every two, three or more intervening cycles of the sustaining voltage pulse train (a pair of positive and negative sustaining voltage pulses correspond to one cycle of the pulse train as shown in the waveform S-900 of FIG. 6), thus ensuring that brightness of the display is not diminished.

What is claimed is:

1. In combination, an apparatus for driving a plasma discharge display including plural display generating electrodes, means for supplying a sustaining voltage pulse train, selective pulse inhibiting means connecting said sustaining pulses supplied by said supplying means therefor to the display electrodes, command responsive means for signalling a display change, said inhibiting means including means responsive to a signal provided by said command responsive means for suppressing one of said sustaining pulses provided by said supplying means therefor and means responsive to a signal provided by said command responsive means for supplying a display modifying signal to a display electrode during the time interval when said sustaining signal is suppressed by said inhibiting means, wherein said inhibiting means comprises gate means, and monostable multivibrator means for disabling said gate means for a timed interval.

* * * * *